US005337829A

United States Patent [19]

Taylor

[11] Patent Number: 5,337,829

[45] Date of Patent: Aug. 16, 1994

[54] HYDRAULIC RELEASE TOOL

[76] Inventor: William T. Taylor, 1412 Cottage Dr., Houma, La. 70360

[21] Appl. No.: 41,547

[22] Filed: Mar. 31, 1993

Related U.S. Application Data

[63] Continuation of Ser. No. 809,729, Dec. 17, 1991, Pat. No. 5,219,027.

[51] Int. Cl.[5] ..... E21B 23/00

[52] U.S. Cl. ..... 166/377; 166/181; 166/242

[58] Field of Search ..... 166/377, 123, 301, 98, 166/181, 242, 178

[56] References Cited

U.S. PATENT DOCUMENTS

| | | | |
|---|---|---|---|
| 3,809,161 | 5/1974 | Carothers | 166/301 |
| 3,851,706 | 12/1974 | Ellis | 166/178 |
| 4,648,445 | 3/1987 | Caskey | 166/181 X |
| 4,706,745 | 11/1987 | Bishop et al. | 166/301 X |
| 4,749,044 | 6/1988 | Skipper et al. | 166/301 X |
| 4,805,699 | 2/1989 | Halbardier | 166/123 X |
| 5,133,412 | 7/1992 | Coronado | 166/123 X |

*Primary Examiner*—Terry Lee Melius

*Attorney, Agent, or Firm*—Matthews and Associates

[57] ABSTRACT

A hydraulic release tool used above any work string which includes an elongated mandril and a releasing means axially and slidingly mounted within the mandril and having an internal stabilizing means and/or external/internal fishing/neck capable of releasing a male conversion means and/or external/internal fishing neck. The male conversion means and/or external/internal fishing neck is disposed at the lower end of the hydraulic release tool, and is released when the work string tools become stuck, thus allowing the stuck work string tools to become relieved by any conventional standardized overshot fishing tool; while also allowing the retrieval of the tubing above the released hydraulic release tool.

11 Claims, 2 Drawing Sheets

HYDRAULIC RELEASE TOOL

CROSS-REFERENCE TO RELATED APPLICATION

This application is a continuation of application Ser. No. 07/809,729, filed on Dec. 17, 1991, which has issued as U.S. Pat. No. 5,219,027.

FIELD OF THE INVENTION

The present invention relates generally to a fishing apparatus utilized within a well bore to free stuck pipe or tools. More specifically, the present invention relates to a hydraulic release tool used in a work string such that when the work string becomes stuck, a male conversion fishing means is released from the hydraulic release tool, allowing the stuck string tools connected therebelow, and/or the tubing connected thereabove, to be relieved.

SUMMARY OF THE INVENTION

During the drilling and completion of deep wells, such as wells for producing petroleum products, objects such as drill pipe, well tools, and other apparatus sometimes become stuck within the well bore and cannot be removed by the application of ordinary upward forces and tools. In such cases, it is useful to implement the hydraulic release tool above the work string such that when tools below the string become lodged or stuck, the hydraulic release tools may be released thus, allowing the tubing above the hydraulic release tool to be easily removed, and the stuck tools therebelow, to be removed by any overshot means of fishing.

Presently, all hydraulic release tools implement a release and conversion means, however, employ an internal fishing neck to be released above the work string. This method is inferior to the overshot means of retrieving stuck tools in the work string, in that much more force is required when using an internal fishing neck to retrieve stuck tools. When using an internal fishing neck to retrieve the work string therebelow, a spear means must enter the female fishing neck above the string to create internal pressure against the internal diameter of the fishing neck, sufficient to dislodge the work string.

However, when implementing a male overshot fishing means to relieve stuck tools, the overshot attaches over the male conversion means of the hydraulic release tool once released, and may simply grasp the male counterpart and dislodge the stuck portion of the work string. Furthermore, conventional hydraulic release tools used today do not have the capability of complete hydraulic fluid circulation allowing the fluid to circulate about the exterior, above and below, of the work string and tubing thereabove once the conversion means is released. The present invention utilizes the improvement of circulating ports that remain closed until release of the male conversion means. Once released, the male conversion means allows the circulating ports to open thus, allowing complete fluid passages from the tubing above the hydraulic release tool, to pass through the ports into the exterior of the tubing and around the tools that remain stuck.

Therefore, the advantages of the present invention lie within the male conversion means, capable of being released by the hydraulic release tool, and the fluid circulation ports, both of which enhance the removal of tubing above the stuck work string and retrieval of the stuck tools, beyond any conventional methods and tools used today.

Accordingly, the present invention is a pioneer method and apparatus for creating an improved means to retrieve stuck tools downhole and remove the free tubing thereabove.

DETAILED DESCRIPTION OF THE DRAWINGS

Figure 1:
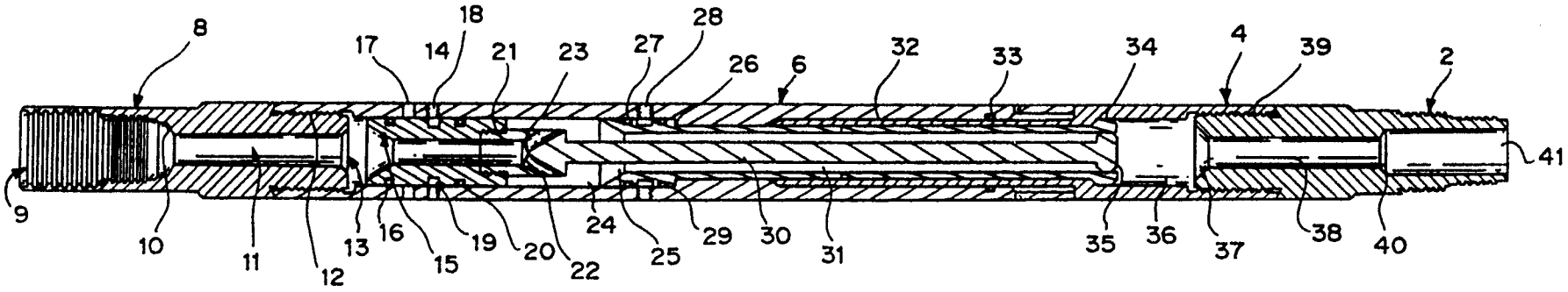
FIG. 1 is a longitudinal cross sectional view of the hydraulic release tool in its secured position.

Referring now to the drawings, FIG. 1 depicts the hydraulic release tool in its secured position wherein 8 is the upper end of the hydraulic release tool threadably connected to the middle mandril portion of the hydraulic release tool 6 at 12, and containing a passage way 11 therethrough. Additionally, the upper portion of the hydraulic release tool 8 contains one threaded internal diameter 9, said threaded portion terminating at internal shoulder 10, enabling the connection of the hydraulic release tool to the work string.

Passageway 11 allows for fluid to pass through the upper end of the hydraulic release tool, into opening 13, through the internal stabilizing mandril 14 and exiting at ports 28 and 22 into chamber 24 of said middle mandril 6, then allowing the fluid to pass through 31 and continuing until reaching chamber 36 of said lower portion of said hydraulic release tool and male conversion means. Thus, any fluid may pass throughout the entire hydraulic release tool and exit through the lower portion of said tool at 37 passing through chambers 38, 40 and exiting at 41 into the wellbore.

The internal stabilizing mandril 14 is secured by set screws 18, which screw into detents 19 and are connected in sealing engagement to the middle mandril 6 by seals 16 and 20. Set screws 18 may be sheared from the detents 19 by pumping fluid through the hydraulic release tool, and releasing a ball as depicted in FIG. 2 at 42, thereby sealing the passageway 21 in the stabilizing mandril 14 and shearing the set screws 18 thus, releasing the stabilizing mandril 35 from its predetermined and secured position as shown in FIG. 1.

Seals 16 and 20 prevent the passage of fluid from escaping through the walls between the upper portion of stabilizing mandril 14 once the pressure up process begins when ball 42 is seated in the passageway of the upper portion of the stabilizing mandril 14 at shoulder 15.

Figure 2:
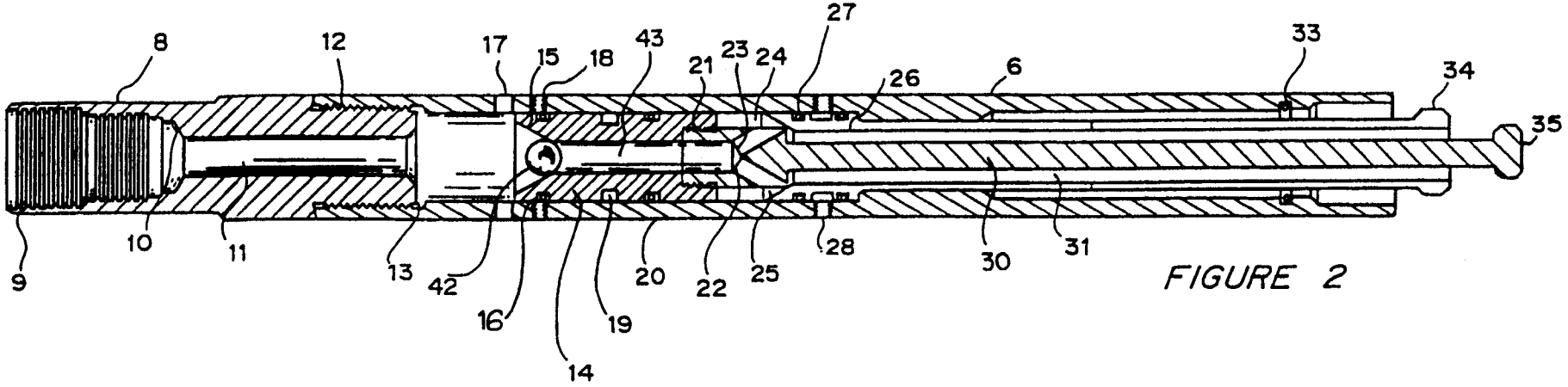
FIG. 2 is a longitudinal cross sectional view of the hydraulic release tool in its released position.

Referring now to FIG. 2, set screws 28 secure a plurality of collets 34 which act to secure the lower portion of the hydraulic release tool, referred to as the male conversion means and/or external/internal fishing 4. When the hydraulic release tool is activated, stabilizing mandril 35 is released from its position as shown in FIG. 1, thus relieving collets 34 from engagement with the male conversion means and/or external internal 4. The hydraulic release tool is in its released position as shown in FIG. 2 which shows the stabilizing mandril 35 passing through the middle mandril 6 into a seated position in middle mandril 6 at shoulder 25, thereby allowing the male conversion means and/or external/internal fishing to detach as depicted in FIG. 3.

Seals 27 and 29 of FIG. 1 prevent the flow of fluid throughout the hydraulic release tool when it is activated to its released position as shown in FIG. 2. Therefore, the upper portion of collets 34 at 26, may be secured by any set screw means as shown at 28, and are constantly stationary until they release into their activated position as shown in FIG. 2 when the hydraulic release tool is activated (pressured up) thus, releasing the stabilizing mandril 35 from its internal pressure on the lower end of said collets at 34. Once the entire stabilizing mandril 14, 30 and 35 is in its released position as shown in FIG. 2, the male conversion means and/or external/internal fishing neck of FIG. 3 is released from the hydraulic release tool, remaining connected to the work string tools therebelow, and allowing the immediate retrieval of the tubing connected to the remainder of the hydraulic release tool depicted in FIG. 2. Still referring to FIG. 2, when the hydraulic release tool is activated to its released position (FIG. 2), circulating ports 17 are opened, thus allowing the "fluid" to pass through upper end 11 of the hydraulic release tool and exiting into the interior of the wellbore allowing the "fluid" to circulate about the exterior of the retrieved tubing, and stuck work string tools therebelow.

Figure 3:
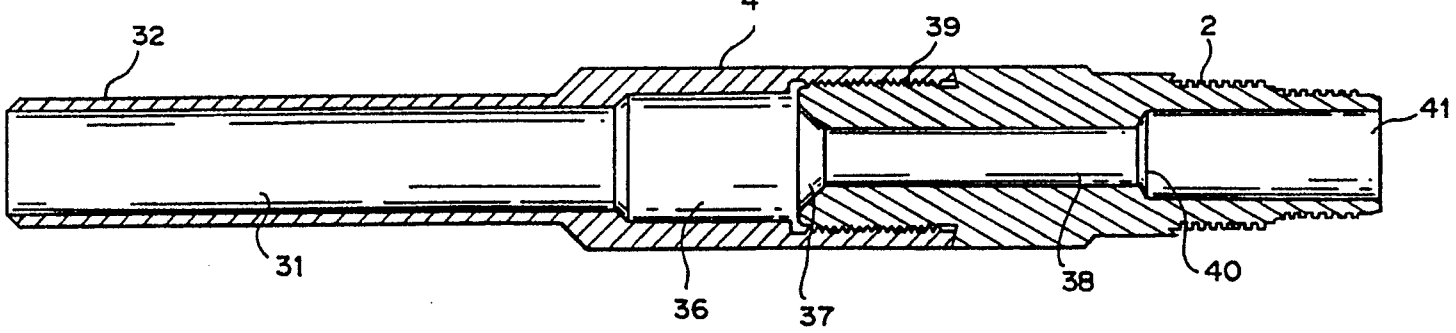
FIG. 3 is a longitudinal cross sectional view of the male conversion means of the hydraulic release tool in its released form.

Referring now to FIG. 3, the male conversion means is slidably interconnected as shown in FIG. 1 through its upper body leaving an internal passage 31 through which fluid may pass when the hydraulic release tool is not activated. The male conversion means and/or external/internal fishing neck of FIG. 3 contains an upper body 32 and a lower body 4 threaded to an even lower body at 39, terminating at its lower most end which is also threaded at 2 to connect to the work string tools. As shown in FIG. 1 at 33, the male conversion means and/or external/internal fishing neck of FIG. 3 is in sealing engagement with middle mandril 6 in order to prevent the passage of fluid therethrough when the hydraulic release tool is activated.

Referring generally now to FIGS. 1 through 3, the hydraulic release tool is in its secured position at FIG. 1 wherein when it is activated (pressured up) and fluid passing therethrough is blocked by ball 42 in seat 15 at the upper portion of said male stabilizing mandril 14, the set screws 18 shear thus, releasing the male stabilizing means 14 and 35 which passes through said middle mandril 6 into seated position at 25 while simultaneously allowing fluid to pass through the now open circulating ports 17 and releasing the lower end of said male stabilizing mandril 35 from its securing position against collets 34, which in turn releases the male conversion means 4.

From the foregoing it can be seen that this invention is one well adapted to obtain all of the ends and objects hereinabove set forth, together with other advantages which are obvious and which are inherent to the apparatus.

It would be understood that certain features and sub combinations are of utility and may be employed with reference to other features and sub combinations. This is contemplated by, and is within the scope of the claims. Since many possible embodiments may be made the invention without departing from the scope thereof, it is to be understood that all matters herein set forth or shown in the accompanying drawings is to be interpreted as illustrative, and not in a limiting sense. The purview of the invention is specified in the appended claims.

What is claimed:

1. A tool for use in a well bore when it is desired to release a work string from a tool string, and the tool is positioned between the work string and tool string, comprising:

(a) a mandril adapted to fit on the work string; and, (b) a release means releasably secured to the lower end of the mandril for releasing the tool string from the work string, including a securing means mounted adjacent to the mandril for securing the release means to the mandril until it is desired to release the work string from the tool string and wherein upon separation, the securing means mounted adjacent to the mandril is activated, thus releasing the tool string in the bore hole.

2. The mandril of claim 1 wherein the mandril has an internal diameter capable of allowing any fluid to pass therethrough to operate lower fishing string tools when fluid is passed through the mandril.

3. The mandril of claim 1 wherein the mandril contains ported bypass and relief openings, initially closed until the release means is released from its secured position from the tool, capable of allowing fluid passage when the ported bypass and relief openings are activated to their open position.

4. The release means of claim 1 further comprising a male extension threadedly connected to a lower threaded extension and temporarily in sliding engagement with the mandril.

5. The release means of claim 1 further comprising an abutment shoulder in temporary engagement with the securing means.

6. The securing means of claim 5 further comprising a plurality of collets positioned in sliding engagement with the mandril and containing a counter abutment shoulder to the release means abutment shoulder and in securing engagement therewith.

7. The securing means of claim 6 further comprising a plurality of set screws stabilizing the collets extending downward and through the mandril, the set screws releasing when the ported bypass and relief openings are activated.

8. The securing means of claim 7 further comprising an upper threaded body connected to a lower male extrusion extending through the collets and holding the collets in securing engagement against the abutment shoulder of the release means.

9. The threaded upper body of claim 8 further comprising a cylindrical shaft extending into the upper portion of the mandril and in threaded connection to the lower stabilizing means.

10. The threaded upper body of claim 9 further comprising a conical opening capable of accepting and preventing any solid object from passing therethrough and activating the release of the securing means, thus releasing the releasable fishing means.

11. A hydraulic release tool for use in a well bore in any given situation where a tool string, has met with an impasse, comprising:

(a) a mandril adapted to fit on the work string;

(b) a release means releasably secured to the lower end of the mandril for releasing the tool string from the work string, including a securing means mounted adjacent to the mandril for securing the release means to the mandril until it is desired to release the work string from the tool string and wherein upon separation, the securing means mounted adjacent to the mandril is activated, thus releasing the tool string in the bore hole; and (c) a circulating means for enabling circulation of fluid through the tool during operation of the tool and while the tool string is suspended by the release means.

* * * * *